US007832805B1

(12) United States Patent
Lai

(10) Patent No.: US 7,832,805 B1
(45) Date of Patent: Nov. 16, 2010

(54) ADJUSTING STRUCTURE FOR AN ARMREST OF A CHAIR

(76) Inventor: Yu-Shan Lai, No. 632, Sec. 1, Shihsian Rd., West District, Chiayi City 600 (TW)

( * ) Notice: Subject to any disclaimer, the term of this patent is extended or adjusted under 35 U.S.C. 154(b) by 54 days.

(21) Appl. No.: 12/475,647

(22) Filed: Jun. 1, 2009

(51) Int. Cl.
*A47C 7/54* (2006.01)

(52) U.S. Cl. ..... 297/411.38; 297/411.32

(58) Field of Classification Search ..... 297/411.32, 297/411.34, 411.38, 411.26, 411.27, 411.35
See application file for complete search history.

(56) References Cited

U.S. PATENT DOCUMENTS 3,544,163 A * 12/1970 Krein ..... 297/411.32
3,807,799 A * 4/1974 Freedman ..... 297/411.32
4,807,935 A * 2/1989 King ..... 297/411.38
5,116,099 A * 5/1992 Kwasnik et al. ..... 297/188.15
5,484,187 A * 1/1996 Doerner et al. ..... 297/411.3
7,384,102 B2 * 6/2008 Chen et al. ..... 297/411.32

* cited by examiner

*Primary Examiner*—Joseph Edell
(74) *Attorney, Agent, or Firm*—Alan Kamrath; Kamrath & Associates PA

(57) ABSTRACT

An adjusting structure for an armrest of a chair comprises a support member, an armrest, a side cover, a press member, a guiding member, a housing, and an engaging unit; wherein in operation, the press member is pressed inward to disengage the guiding member from the limiting recess of the support member. Thereafter, the armrest is adjusted to tilt forward so that the screw elements and the guiding member are guided toward a predetermined orientation along the arcuate groove, and the engaging unit abuts against the support member, thereby positioning the armrest.

2 Claims, 4 Drawing Sheets

ADJUSTING STRUCTURE FOR AN ARMREST OF A CHAIR

BACKGROUND OF THE INVENTION

1. Field of the Invention

The present invention relates to an adjusting structure for an armrest of a chair that is adjusted easily to position the armrest securely.

2. Description of the Prior

Conventional adjusting structures for an armrest of a chair is used to adjust a vertical movement of the armrest, a movement thereof in X axis, and a movement thereof in Y axis, however, they are complicated to be operated easily.

The present invention has arisen to mitigate and/or obviate the afore-described disadvantages.

SUMMARY OF THE INVENTION

The primary object of the present invention is to provide an adjusting structure for an armrest of a chair that is adjusted easily to position the armrest securely.

An adjusting structure for an armrest of a chair in accordance with a preferred embodiment of the present invention comprises:

a support member, an armrest, a side cover, a press member, a guiding member, a housing, and an engaging unit; wherein the support member includes a first bore and two arcuate grooves, all of which are disposed on a vertical section thereof, the arcuate groove proximate to a lower side of the vertical section of the support member includes a limiting recess mounted on a lower side thereof, and the support member also includes a plurality of slots fixed on a horizontal section thereof, such that the support member allows to be engaged to a seat by using a number of screw elements;

the armrest includes a second bore, a third bore, a fourth bore, all of which are arranged on a lower side thereof; and a notch formed on a bottom end thereof;

the side cover includes an upper orifice and a lower orifice in response to the third bore and the second bore respectively, and includes a receiving chamber formed on a bottom end of an inner side thereof to insert the press member, a fitting zone disposed on the inner side thereof to receive a lower section of the armrest, and a cutout disposed on a bottom end thereof;

the press member includes a through orifice mounted on a vertical section thereof to insert a second projection of the guiding member therein, and an arcuate defining tab formed on a bottom end thereof;

the guiding member includes a first projection extending from an upper side thereof and the second projection extending from a middle portion thereof;

the housing is covered to an outer side of the side cover;

the engaging unit includes a second resilient element and a steel ball to be received in an opening of the side cover and the fourth bore of the armrest so that the steel ball is pushed by the second resilient element to abut against the support member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
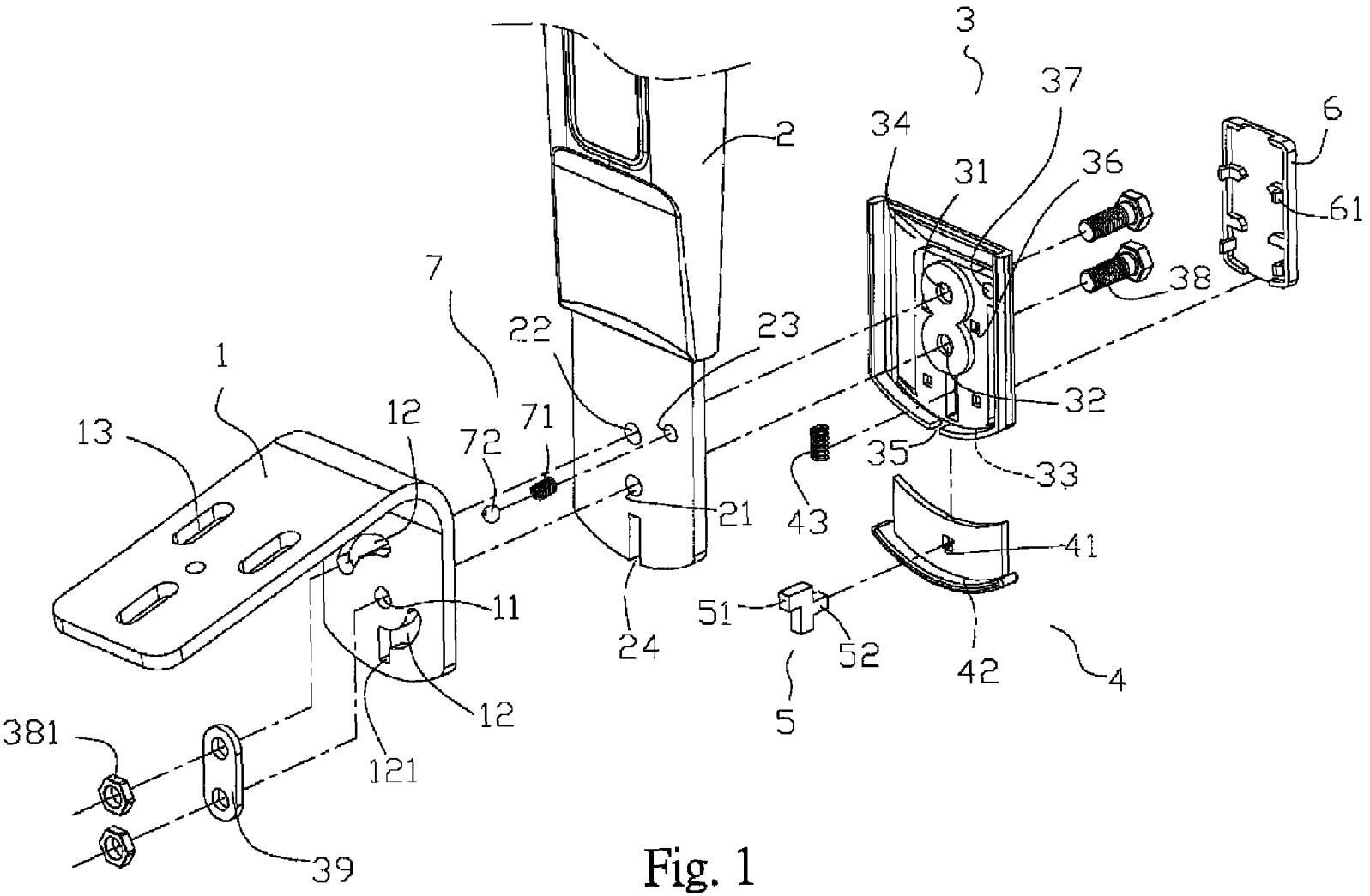
FIG. 1 is a perspective view showing the exploded components of an adjusting structure for an armrest of a chair according to a preferred of the present invention.
Figure 2:
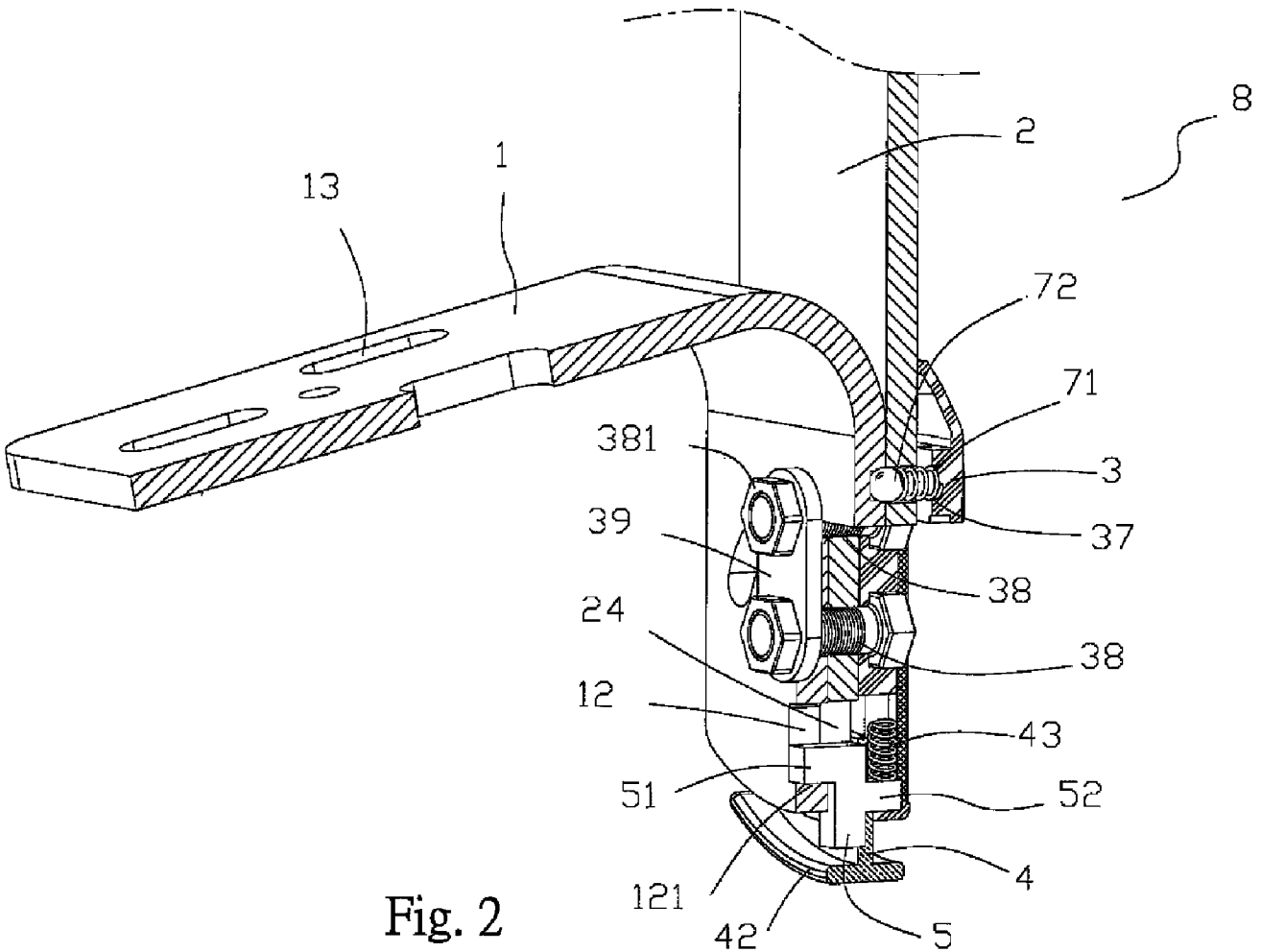
FIG. 2 is a perspective view showing the assembly of the adjusting structure for the armrest of the chair according to the preferred embodiment of the present invention.
Figure 4:
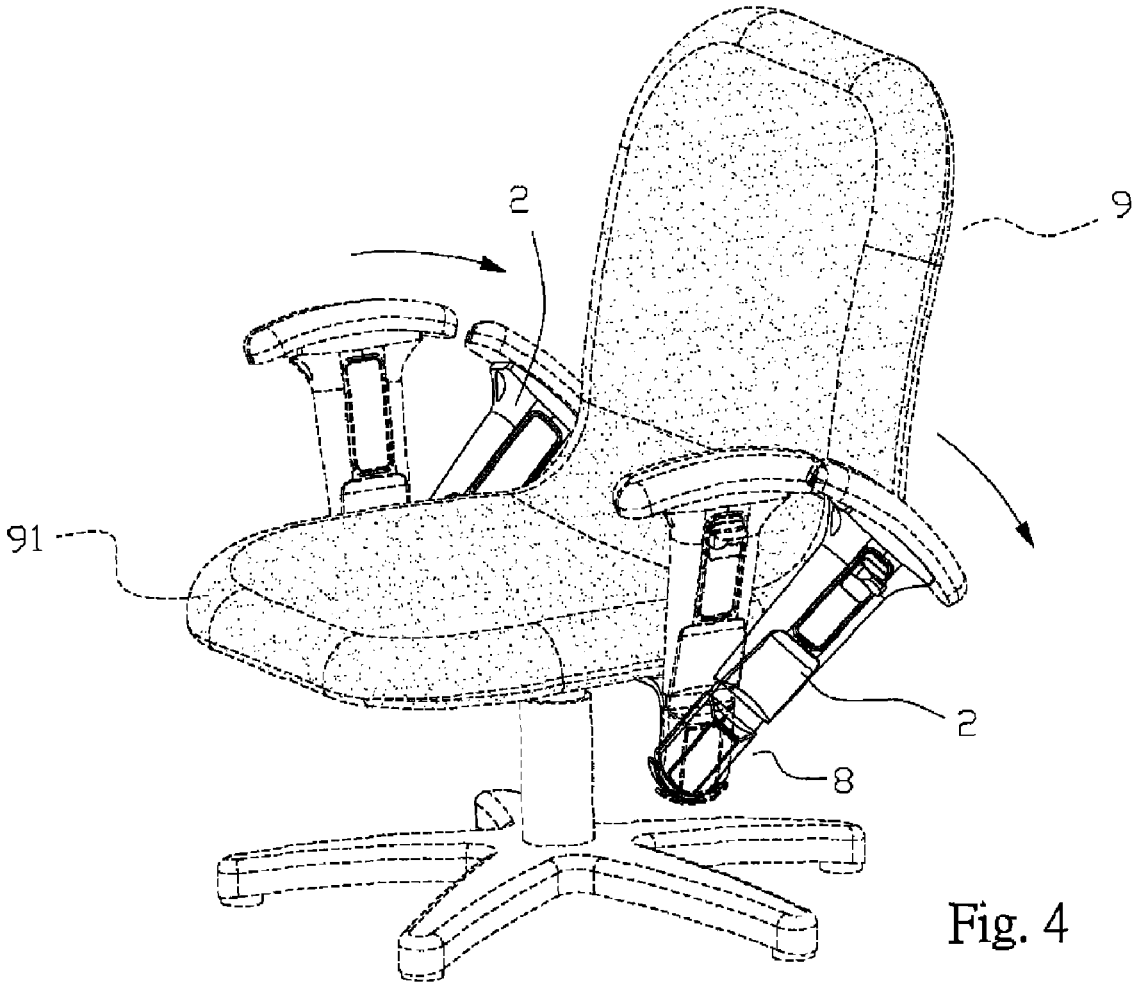
FIG. 4 is a perspective view showing the adjusting structure for the armrest being installed to the chair according to the preferred embodiment of the present invention.

Referring to FIGS. 1-2, an adjusting structure 8 for an armrest of a chair in accordance with a preferred embodiment of the present invention comprises: a support member 1, an armrest 2, a side cover 3, a press member 4, a guiding member 5, a housing 6, and an engaging unit 7; wherein the support member 1 includes a first bore 11 and two arcuate grooves 12, all of which are disposed on a vertical section thereof, the arcuate groove 12 proximate to a lower side of the vertical section of the support member 1 includes a limiting recess 121 mounted on a lower side thereof, and the support member 1 also includes a plurality of slots 13 fixed on a horizontal section thereof, such that the support member 1 allows to be engaged to a seat 91 (as shown in FIG. 4) by using a number of screw elements;

the armrest 2 includes a second bore 21, a third bore 22, a fourth bore 23, all of which are arranged on a lower side thereof, and a notch 24 formed on a bottom end thereof;

the side cover 3 includes an upper orifice 31 and a lower orifice 32 in response to the third bore 22 and the second bore 21 respectively, and includes a receiving chamber 33 formed on a bottom end of an inner side thereof to insert the press member 4, a fitting zone 34 disposed on the inner side thereof to receive a lower section of the armrest 2, and a cutout 35 disposed on a bottom end thereof;

the press member 4 includes a through orifice 41 mounted on a vertical section thereof to insert a second projection 52 of the guiding member 5 therein, and an arcuate defining tab 42 formed on a bottom end thereof;

the guiding member 5 includes a first projection 51 extending from an upper side thereof and the second projection 52 extending from a middle portion thereof;

the housing 6 is covered to an outer side of the side cover 3 and includes a plurality of hooks 61 extending from a peripheral wall thereof to engage with a number of through apertures 36 of the side cover 3;

the engaging unit 7 includes a second resilient element 71 and a steel ball 72 to be received in an opening 37 of the side cover 3 and the fourth bore 23 of the armrest 2 so that the steel ball 72 is pushed by the second resilient element 71 to abut against the support member 1.

In assembly, the lower side of the armrest 2 is biased against the vertical section of the support member 1, and the fitting zone 34 of the side cover 3 is contacted with the lower side of the armrest 2 to cover the side cover 3 to the lower side of the armrest 2 after placing the second resilient element 71 and the steel ball 72 to the opening 37 of the side cover 3 and the fourth bore 23 of the armrest 2, such that the steel ball 72 which is pushed by the second resilient element 71 can contact with the support member 1.

Besides, the press member 4 is inserted to be positioned to the receiving chamber 33 of the side cover 3 by ways of the guiding member 5, and the second projection 52 of the guiding member 5 is pushed by a first resilient element 43 of the press member 4 so that the press member 4 is in a downward pressing state, and the first projection 51 of the guiding member 5 is retained between the notch 24 of the armrest 2 and the limiting recess 121 of the support member 1.

Thereafter, a plurality of screw elements 38 are individually inserted through the upper orifice 31, the third bore 22, the lower orifice 32, the second bore 21 to project out of the arcuate groove 12 and the first bore 11 of the support member 1 to screw with a washer 39 and two nuts 381. Furthermore, the hooks 61 of the housing 6 are retained in the through apertures 36 of the side cover 3, thereby assembly the adjusting structure 8 of the armrest.

Figure 3:
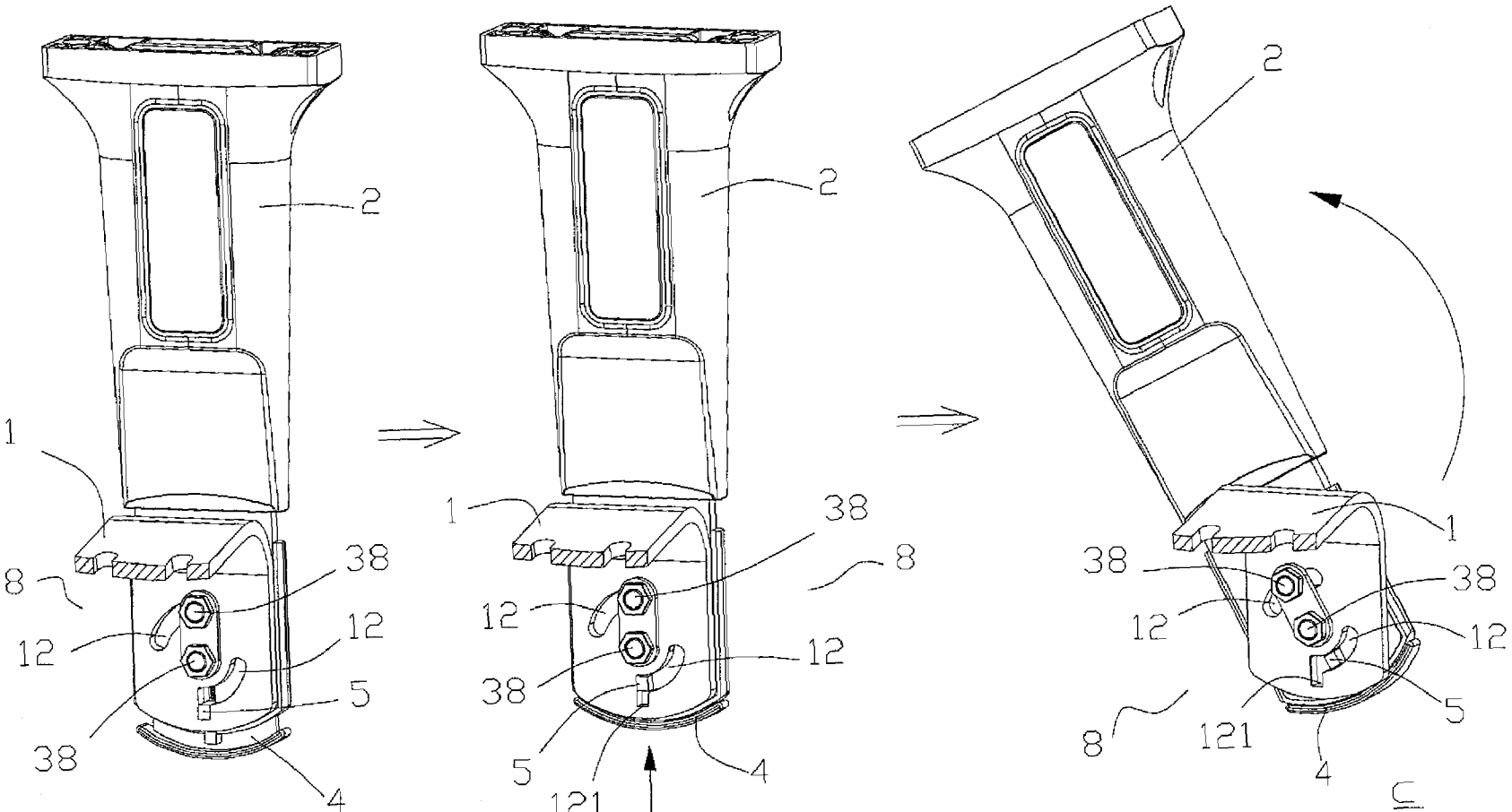
FIG. 3 is a side plan view showing the operation of the adjusting structure for the armrest of the chair according to the preferred embodiment of the present invention.

In operation (as shown in step a of FIG. 3 and FIG. 4), the press member 4 is pressed inward (as illustrated in step b of FIG. 3) to disengage the guiding member 5 from the limiting recess 121 of the support member 1. Thereafter, the armrest 2 is adjusted to tilt forward (as shown in step c of FIG. 3) so that the screw elements 38 and the guiding member 5 are guided toward a predetermined orientation along the arcuate groove 12, and the engaging unit 7 abuts against the support member 1 (as illustrated in FIGS. 1-2), thereby positioning the armrest 2.

While we have shown and described various embodiments in accordance with the present invention, it is clear to those skilled in the art that further embodiments may be made without departing from the scope of the present invention.

What is claimed is:

1. An adjusting structure for an armrest of a chair comprising:

a support member, an armrest, a side cover, a press member, a guiding member, a housing, and an engaging unit; wherein the support member includes a first bore and two arcuate grooves, all of which are disposed on a vertical section thereof, one of the two arcuate grooves is proximate to a lower side of the vertical section of the support member and includes a limiting recess mounted on a lower side thereof, and the support member also includes a plurality of slots fixed on a horizontal section thereof, such that the support member is adapted to be engaged to a seat by using a number of screw elements;

the armrest includes a second bore, a third bore, a fourth bore, all of which are arranged on a lower side thereof, and a notch formed on a bottom end thereof;

the side cover includes an upper orifice and a lower orifice aligned with the third bore and the second bore respectively, and includes a receiving chamber formed on a bottom end of an inner side thereof to insert the press member, a fitting zone disposed on the inner side thereof to receive a lower section of the armrest, and a cutout disposed on the bottom end thereof;

the press member includes a through orifice mounted on a vertical section thereof to insert a second projection of the guiding member therein, and an arcuate defining tab formed on a bottom end thereof;

the guiding member includes a first projection extending from an upper side thereof and the second projection extending from a middle portion thereof;

the housing is covered to an outer side of the side cover;

the engaging unit includes a second resilient element and a steel ball to be received in an opening of the side cover and the fourth bore of the armrest so that the steel ball is pushed by the second resilient element to abut against the support member.

2. The adjusting structure for the armrest of the chair as claimed in claim 1, wherein the housing includes a plurality of hooks extending from a peripheral wall thereof to engage with a number of through apertures of the side cover.

* * * * *